US012624598B2

(12) United States Patent
Constantine

(10) Patent No.: US 12,624,598 B2
(45) Date of Patent: May 12, 2026

(54) FIBER-TO-CASING BONDING

(71) Applicant: CONOCOPHILLIPS COMPANY, Houston, TX (US)

(72) Inventor: Jesse Constantine, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 19/067,919

(22) Filed: Mar. 2, 2025

(65) Prior Publication Data

US 2025/0277414 A1 Sep. 4, 2025

Related U.S. Application Data

(60) Provisional application No. 63/561,085, filed on Mar. 4, 2024.

(51) Int. Cl.
*E21B 17/02* (2006.01)
*E21B 19/22* (2006.01)

(52) U.S. Cl.
CPC ..... *E21B 17/026* (2013.01); *E21B 19/22* (2013.01)

(58) Field of Classification Search
CPC ..... E21B 17/026; E21B 17/20; E21B 17/206; E21B 19/22
See application file for complete search history.

(56) References Cited

U.S. PATENT DOCUMENTS 10,955,264 B2 3/2021 Brown et al.
11,168,543 B2 * 11/2021 Purkis ..... G02B 6/502
11,448,026 B1 * 9/2022 Al-Mousa ..... E21B 17/023
11,525,310 B2 12/2022 Vandellyn et al.
12,195,668 B2 * 1/2025 Byrd ..... E21B 23/14
2011/0024103 A1 * 2/2011 Storm, Jr. ..... E21B 17/206 166/65.1
2011/0079401 A1 * 4/2011 Gambier ..... E21B 23/08 166/117.6
2014/0196893 A1 * 7/2014 Vigneaux ..... E21B 47/135 166/305.1
2016/0215578 A1 * 7/2016 Adnan ..... E21B 23/01
2016/0362968 A1 12/2016 Kriesels et al.
2019/0284890 A1 * 9/2019 Purkis ..... E21B 17/20
2025/0277414 A1 * 9/2025 Constantine ..... E21B 19/22

FOREIGN PATENT DOCUMENTS

WO WO-2017116970 A1 * 7/2017 ..... E21B 19/22

OTHER PUBLICATIONS

International Search Report and Written Opinion for application PCT/US2025/018052 dated Jul. 8, 2025.
Crawford, R. "Disposable fibre optic surveys optimise wells and reduce CO2 emissions in unconventional assets" Paper No. SPE-217339-MS presented at the Asia Pacific Unconventional Resources Symposium, Brisbane, Australia 2023.

* cited by examiner

*Primary Examiner* — Jennifer H Gay
(74) *Attorney, Agent, or Firm* — Boulware & Valoir PLLC

(57) ABSTRACT

Methods and tools for deploying cables, such as fiber optic cable, downhole in well using adhesive to adhere the cable to an inside surface of a casing.

16 Claims, 5 Drawing Sheets

FIBER-TO-CASING BONDING

PRIOR RELATED APPLICATIONS

This application claims priority to U.S. Ser. No. 63/561,085, filed on Mar. 4, 2024, and incorporated by reference in its entirety for all purposes.

FEDERALLY SPONSORED RESEARCH STATEMENT

Not applicable.

REFERENCE TO MICROFICHE APPENDIX

Not applicable.

FIELD OF THE DISCLOSURE

This invention relates generally to methods of installing cable, such as fiber-optic cable, downhole in a well.

BACKGROUND OF THE DISCLOSURE

Fiber-optic sensing technology has been in use a long time, but only recently has been successful in the oil and gas industry. Initial attempts in downhole applications were often unsatisfactory or even wholly failed, usually due to cable degradation in the harsh environment. However, once sufficiently hardened cables were developed to cope with high pressures, temperatures, movement of fluids, and corrosive chemicals, the application of this technology has become practical, and it is now being robustly developed for various applications.

Compared with electronic based sensing tools, fiber-optic sensing has many advantages. First, all the sensing instruments are at the surface, so there is no power supply, moving parts, or electronics required in the borehole. Also, fiber-optic sensing can provide measurements along the entire fiber length (as long as 10 miles) with a spatial resolution in terms of feet. Thus, it can cover the entire well bore simultaneously without having to move the tools. Finally, the diameter of the sensing fibers is usually in the range of millimeters, which can be easily integrated into the existing wireline, coil tubing, or carbon-rod cables, and they can be protected to endure harsh downhole environments.

However, installation of fiber-optic and similar cables continues to be difficult. Installing the sensing cables on production casing traditionally requires manual installation using clamps to secure the cables on the casing, clamps to detect the orientation of the cable, blast protectors and flatpacks to protect the cable, all of which contributes to difficulty, time, and expense.

U.S. Pat. No. 11,525,310 by Halliburton Energy Services describes a more automated method of installing cable, however. In this method, the cable is placed on the outer surface of casing, while running the casing downhole. The optical fiber cable is positioned on the outer surface of the pipe and affixed using a pressure sensitive adhesive tape. In some embodiments, the tape is run linearly along the cable, and in others the tape is wound around the casing in a helix. Wrapping devices to apply the tape are also provided, and their speed must reflect the speed of running the pipe downhole.

While a significant improvement over the prior art, this method could be further improved. One of the disadvantages, is the need to maintain cable integrity while the completed pipe is fed downhole and while introducing the next piece of pipe. Since each new pipe is moved into place and screwed into the last piece, the potential for cable damage is increased at these times. Furthermore, this method places the cable outside of the casing, and many methods preferably employ an internal cable, rather than an external cable where signals from the oil or rock may be attenuated or even lost. Further, the cable may be damaged in cementing the casing as well as during other completion processes.

Thus, what is needed in the art are better methods, devices, and systems for installing cables downhole in a well. The ideal method will be fully automated, protect the cable throughout, and provide an internal cable for optimal sensitivity.

SUMMARY OF THE DISCLOSURE

The systems, tools and methods described herein automate sensor cable installation. The inventive method installs the cable after the casing is deployed and cased. Since there is no casing movement at this point, the installation is safer with reduced risk of damage. Also, the cable is installed inside the casing, not on the exterior surface. This allows detection of minute changes in the hydrocarbon being produced, as the sensor cable is in the hydrocarbon. A third difference is the use of a liquid glue, rather than an adhesive tape, to adhere the cable to the casing.

One of the embodiments for deploying a cable is to coat the cable with adhesive at the surface while it is being deployed. A weight at the downhole end of the cable will fall, dragging the cable with it, and if needed a device can be sent downhole to bias the cable against the casing wall. The adhesive will then cure in any suitable manner. Curing may be done with heat and time, a UV lamp may be sent downhole, a chemical hardener added to the fluid in the well, or a device can be sent downhole deploying a hardener and providing a biasing effect.

As another option, an existing tool may be reconfigured for use, or a new specialty tool can be developed. For our proof-of-concept work, we chose to repurpose an existing tool. The "Wellsense FiberLine Intervention" tool or "FLIT", as described in U.S. Pat. No. 10,955,264, deploys a disposable fiber-optic cable down hole via an internal bobbin on which cable is wound, and is combined with a surface acquisition system, that processes the data gathered by the fiber sensors. The FLIT is launched from surface and free-falls into the well, although for horizontal wells, the tool may be pushed by any means known in the art. As it falls, the tool deploys 'bare' optical fibers which unspool from the bobbin as it falls. The fiber is not completely bare, but it does lack the multiple coatings and metal jacket that characterize most fiber sensors. Typically, the fiber has a coat of acrylate, but specialty coatings are also possible, although contributing to cost.

The cable is spooled on to the bobbin inside the tool with grease, and the grease helps the cable to somewhat adhere to casing when deployed. However, since the cable is intended to be disposable, adherence is not a significant issue, although any displacement under external load, such as flowing fluids, will of course affect the data.

We propose to modify the basic concept of this tool to deploy the fiber coated with adhesive, not grease, and thereby adhere it to the casing wall. When using a repurposed FLIT, a second tool may be deployed to press the cable against the casing and providing a hardening function, or these functions may be bolted or otherwise attached to the existing tool. Whether the tools are separate or together is a design choice, but where a UV light is used, a separate hardener device that can be deployed at a controlled rate of speed may be preferred in vertical wells, where free fall may not provide sufficient UV exposure for curing. Where the tool is pushed, e.g., in a horizontal well, these components may be combined since the speed can easily be controlled.

We anticipate that ultimately a specialty tool will be developed for cable installation. In the cable installation tool developed herein, there is a housing containing a bobbin, an adhesive, a pressor, and a hardener, although as mentioned the latter two may be in a separate tool. The fiber cable is spooled onto the bobbin with an adhesive, preferably an epoxy adhesive, or the adhesive may be held in a separate tank and deployed on unwinding of the cable. When the cable exits the tool, it is pressed against the casing by the pressor, and the adhesive then set with the hardener which uses one or more of a chemical hardener, UV light, oxygen, heat, and the like.

Thus, the tool consists of a housing, inside of which is a bobbin over which the fiber is wound along with an adhesive either on the cable or held separately until deployment. Behind the spool and at least partially emerging from the housing is a pressor, that presses the cable against the casing wall, although this can be omitted for horizontal wells as buoyancy will float the cable to the inner casing wall. Also optionally contained therein is either a strong UV light source, which can project that light outside the housing onto the cable, or the UV lamp may be mounted outside the housing. Also, optionally inside the housing is a container with a chemical hardener which is deployed onto the adhesive to cure it. Also, optionally inside the housing is an adhesive tank.

Where a chemical hardener is used, it may be positioned behind the bobbin, such that unwound cable is coated with the hardeners as it is deployed, care being taken that the speed of hardening is suitable for the means of deployment. In another embodiment, the hardener tank is inside the housing, but a feed line delivers the hardener to the cable at the pressor tip such that the hardener is deposited on the cable after it is pressed to the wall.

In another embodiment, both the adhesive and the hardener are contained in tanks, which combine and are added to the cable right behind the pressor via feedline. Alternatively, the feed line for the combined adhesive hardener may be contained within the pressor so that the cable is pressed against the wall and simultaneously the fluid mix deposited thereon. In yet another embodiment, the glue and hardener are kept and delivered separately via two feed lines.

In one embodiment, the same tool contains each of the bobbin, glue, pressor, and hardener. In another embodiment, the pressor and/or hardener are a separate tool, deployed after the bobbin. In some embodiments, the separate tool may also contain the adhesive.

In one embodiment, the pressor is merely that the cable port is biased (e.g., spring biased) to press against the casing wall or arms are provided for same. In other embodiments, two or more pressor arms, preferably at least 3, that are outwardly biased will also function to keep the tool aligned (centralized) during deployment.

The installation may deploy a single fiber-optic cable for use e.g., in Single Mode (DAS) or Multi-Mode (DTS), or two cables may be installed (Trade named BiFLI®) for Single Mode (DAS) and Multi-Mode (DTS). In some embodiments, an additional cable is added thereto, to e.g., communicate sensor data to the surface. In other embodiments, data from various sensors could be wirelessly communicated.

Once installed, the fiber-optic cable can be used for any known or to be developed application, including e.g., distributed measurements for: cement assurance, gas lift optimization, leak detection, vertical seismic profiling, microseismic monitoring, injection or production monitoring, stimulation diagnostics, directional surveys, HD camera, single point pressure/temp/flow measurements, fluid identification/holdup, and/or communication with downhole equipment.

The invention includes any one or more of the following embodiments, in any combination(s) thereof:

A method of installing a sensor cable downhole in a well, comprising a) deploying a spool of fiber-optic cable down a casing in a well so that said cable unwinds and lies against an interior wall of said casing; b) applying an epoxy resin and optionally a hardener against said cable; and c) curing said epoxy resin.

A method of installing a sensor cable downhole in a well, comprising a) deploying a spool of fiber-optic cable inside a casing in a well, said cable having a downhole end weighted by a dart and an opposite end held at surface above said well, said cable being deployed against an interior wall of said casing; b) applying an epoxy resin to said cable using an inline resin applicator at said surface during said deploying step a); and hardening said adhesive with a hardener after said fiber-optic cable is fully deployed.

A method of installing a sensor cable downhole in a well, comprising a) deploying a tool downhole into an interior of a casing of a well, said tool comprising: i) a housing containing a bobbin, said bobbin having a sensor cable wound therearound, said bobbin configured to unwind said sensor cable from said bobbin as said tool is deployed; ii) said housing having a cable port for egress of said sensor cable at a back end of said housing; iii) said housing containing an adhesive tank containing an adhesive and a hardener tank containing a hardener for said adhesive; iv) said adhesive tank having an outlet fluidly connected to a feed line and said hardener tank having an outlet fluidly connected to said feed line; v) said feed line depositing mixed adhesive and hardener onto said egressed sensor cable behind said pressor; b) unwinding said sensor cable as said tool is deployed, and said sensor cable emerging from said cable port; and c) affixing said sensor cable against said casing with said mixed adhesive and hardener as said tool is deployed.

A method of installing a sensor cable downhole in a well, comprising a) deploying a tool downhole into a casing of a well, said tool comprising: i) a generally cylindrical housing having a nose cone at a front end and having a back end; ii) said housing containing a bobbin, said bobbin having a sensor cable wound therearound, said bobbin configured to unwind said sensor cable from said bobbin as said tool is deployed; iii) said housing having a cable port for egress of said sensor cable at said back end; iv) two or more pressors attached to said housing and configured to outwardly bias said pressors and said egressed sensor cable against a casing wall; v) said housing containing an adhesive tank containing an adhesive and a hardener tank containing a hardener for said adhesive; vi) said adhesive tank having an outlet fluidly connected to a feed line and said hardener tank having an outlet fluidly connected to said feed line; vii) said feed line depositing mixed adhesive and hardener onto said egressed sensor cable before, at, or behind (preferably behind) said pressors; b) unwinding said sensor cable as said tool is deployed, said sensor cable emerging from said cable port; and c) pressing said emerged sensor cable against said casing with one of said pressors as tool is deployed.

A method of installing a sensor cable downhole in a well, comprising a) deploying a tool downhole into an interior of a casing of a well, said tool comprising: i) a generally cylindrical housing having a nose cone at a front end and having a back end; ii) said housing containing a bobbin, said bobbin having a sensor cable wound therearound, said bobbin configured to unwind said sensor cable from said bobbin as said tool is deployed; iii) said housing having a cable port for egress of said sensor cable at said back end; iv) two or more pressors attached to said housing and configured to outwardly bias said pressors and said egressed sensor cable against a casing wall; v) said housing containing an adhesive tank containing an adhesive and a hardener tank containing a hardener for said adhesive; vi) said adhesive tank having an outlet fluidly connected to a first feed line and said hardener tank having an outlet fluidly connected to a second feed line; vii) said first feed line depositing adhesive and said second feed line depositing hardener onto said egressed sensor cable before, at, or behind (preferably behind) said pressor; b) unwinding said sensor cable as said tool is deployed, and said sensor cable emerging from said cable port; c) pressing said emerging sensor cable against said casing with one of said pressors as said tool is deployed; and d) affixing said sensor cable against said casing with said adhesive and hardener.

Any method herein described, wherein said sensor cable comprises at least a fiber-optic cable, a wireline, or a combination of one or more wirelines and fiber-optic cables.

Any method herein described, wherein said housing further comprising a sensor package for measuring data selected from one or more of temperature data, pressure data, flow data, depth data, strain data, and position data.

Any method herein described, wherein said housing further comprising a communication package for wireless or optical or electrical communication of said data to a surface processor.

Any method herein described, wherein said hardener is selected from one or more of a UV light source, a temperature, oxygen, a chemical hardener, or combinations thereof.

Any method herein described, wherein said cable port is off-center so as to place said sensor cable directly against said casing.

Any cable deployment tool herein described.

As used herein, "adhesive" means a non-metallic substance applied to one or both surfaces of two separate items that binds them together and resists their separation and which is typically cured or set with the aid of a chemical hardener or heat or light or combinations thereof. Other adhesives such as thermosetting adhesives, $O_2$ or UV cured adhesives may also be used.

A preferred adhesive used herein must be able to withstand high temperature and pressure and contact with oil and simulation fluids without dissolving therein or being significantly diluted. Suitable adhesives include various epoxy resins, and epoxy-urethane resins.

Commercial resins may include ControlSEAL® by Wild Well Control® which maintains long-term durability using non-shrinking, non-corrosive, and impermeable design. RiLOCK® Resin Sealant by Riteks® is an epoxy resin with hardeners, diluents, bonding enhancers, and solid particulates formulated to function across a wide range of well conditions and geometries. The chemistry is the same as commercial epoxy glue, but Ritek has tailored the reaction kinetics and thermodynamics of this chemistry to achieve seal durability far beyond that demonstrated by other resins. WellCem® also make proprietary resins, as do several other oilfield service providers. Oilfield adhesives may also be applied including 3M® HI-STRENGTH™ or DOW® DOWSIL™ or LORD's® 7610D™ direct to metal adhesive.

As used herein, a "hardener" means a chemical or condition that functions to cure the adhesive under downhole conditions and time constraints, and thus different hardeners may be selected depending on downhole temperatures, or whether the well is vertical versus horizontal, and the like. Hardeners include temperature, oxygen, UV light, various chemicals, and combinations thereof. Most classes of hardeners require high temperatures of around 150° C. for curing, and most wells are about 150-350° C. The hardener may be contained in "hardener tank" in the tools described herein. However, the hardener tank may be omitted entirely with a thermosetting adhesive.

A chemical curing agent or hardener generally has a reactive hydrogen that reacts with the epoxide groups in the resin. Some commonly used classes of hardeners, in increasing order of reactivity are: phenols, anhydrides, aromatic amines, cycloaliphatic amines, aliphatic amines and thiols. Example hardeners may include polyethylene polyamine (PEPA), polyamide polyamine (PAPA), diethylene triamine (DETA), and the like. Commercial hardeners may be selected based on the temperatures and chemical compositions encountered as is known to a person of ordinary skill in the art.

Our focus has been on delaying the cure time for about 6 to 8 hours. This allows approximately 3 to 4 hours to pump the tool to a final depth. However, cure times may vary with well temperature and length and chemical combinations chosen.

As used herein, "pressor" means a tool component that drives the cable to the wall of the casing. Typically, this will be some kind of spring biased arm or surface, that will adjust in position if there are any casing malformations, and preferably there are at least 2, 3 or 4, or even 5 or 6, thus also keeping the tool centralized.

We have been focused mainly on buoyancy use and omitted the pressor in some of our horizontal well tests. The weight of the cable is heavier than the water we are pumping with, while the fiber and coating is neutrally buoyant in ~12 lb/gal fluid weights. Anything less, like water with a 8.4 lb/gal weight and the fiber, sinks. These buoyancy differences can be used to achieve or assist the pressor function, at least in horizontal well where a sinking cable will adhere to the bottom of the horizontal casing, or a floating cable will rise to the top.

A "bobbin" is a cylinder or spindle or spool over which cable can be wound that has end flanges of larger diameter to protect the cable wound over the spool. Typically, it is mounted inside the housing so as to allow rotation, but this is not essential as the cable can unwind even if the bobbin is fixed, and the FLIT has a fixed bobbin.

A "cable guide" is any protrusion or tube inside the housing that serves to contain or direct the cable, and guide it towards the cable port. These are not essential components, but may assist in smooth deployment, especially where the inside of the housing becomes more complex with added components.

A "cable port" is the opening in the housing where the cable exits. This is at the back end of the tool. The cable is attached or held at the surface, so that when the tool is deployed downhole, it naturally unwinds from the bobbin.

In use herein we consider the downhole, nose end of the tool as the front, and the other end the back. Thus, cable exits from the back of the tool.

As used herein, a "clean-out" may use a wash solution optionally including one or more pigs to clean the internal surfaces before installing the fiber-optic cable.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements, that do not substantially change the nature of the invention.

The following abbreviations are used herein:

| Abbreviation | Term |
|---|---|
| BHP | Bottomhole pressure |
| BHT | Bottomhole temperature |
| DAS | Distributed acoustic sensing |
| DTS | Distributed temperature sensing |
| FLIT | FiberLine Intervention tool |
| PEPA | Polyethylene polyamine |
| PAPA | Polyamide polyamine |
| DETA | Diethylene triamine |

DESCRIPTION OF EMBODIMENTS OF THE INVENTION

The invention provides a novel method of installing a cable inside the casing of a well, wherein the cable is deployed via spool and an adhesive used to adhere the cable to the casing.

Figure 1:
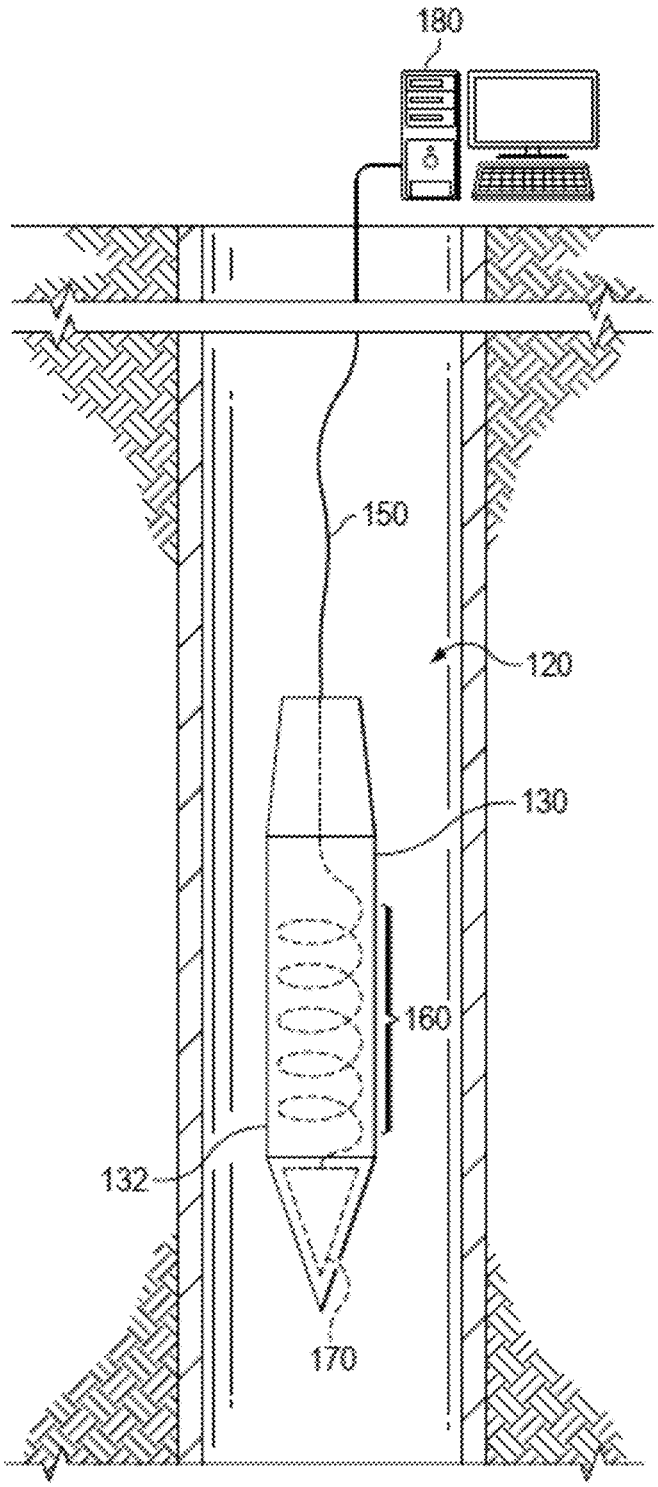
FIG. 1 (PRIOR ART)
FIG. 1 Prior art Wellsense FLIT.

FIG. 1 shows the prior art WellSense FLI tool, herein abbreviated FLIT. A FLIT 130 is shown traveling down a wellbore 120. Housing 132 is made of a soluble material, such as aluminum or magnesium alloys, that can be configured to dissolve after a certain exposure period or time interval (e.g., about 4 days to 2 months). A spool or bobbin 160 is configured such that the spool unwinds as the tool is deployed and a fiber-line 150 is thereby made to extend between the surface and the tool and connect with a surface processor 180. The tool can further be configured with bottomhole pressure ("BHP") and bottom-hole temperature ("BHT") sensors 170 that allow BHP and BHT measurements to be made and communicated to the surface in real time over the fiber-line. In an embodiment, sensor package 170 can also include a fiber-line communications interface that communicates the sensor information to processor 180.

Figure 2A:
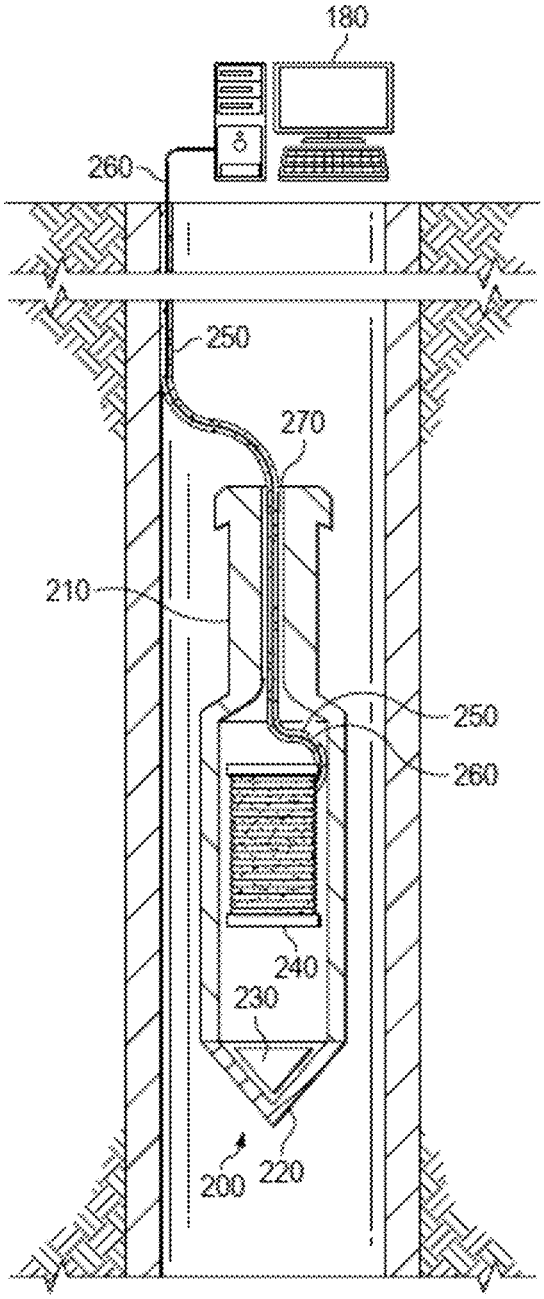
FIG. 2A PRIOR ART
FIG. 2A-B Comparison of Wellsense FLIT and modified tool of the invention.
Figure 2B:
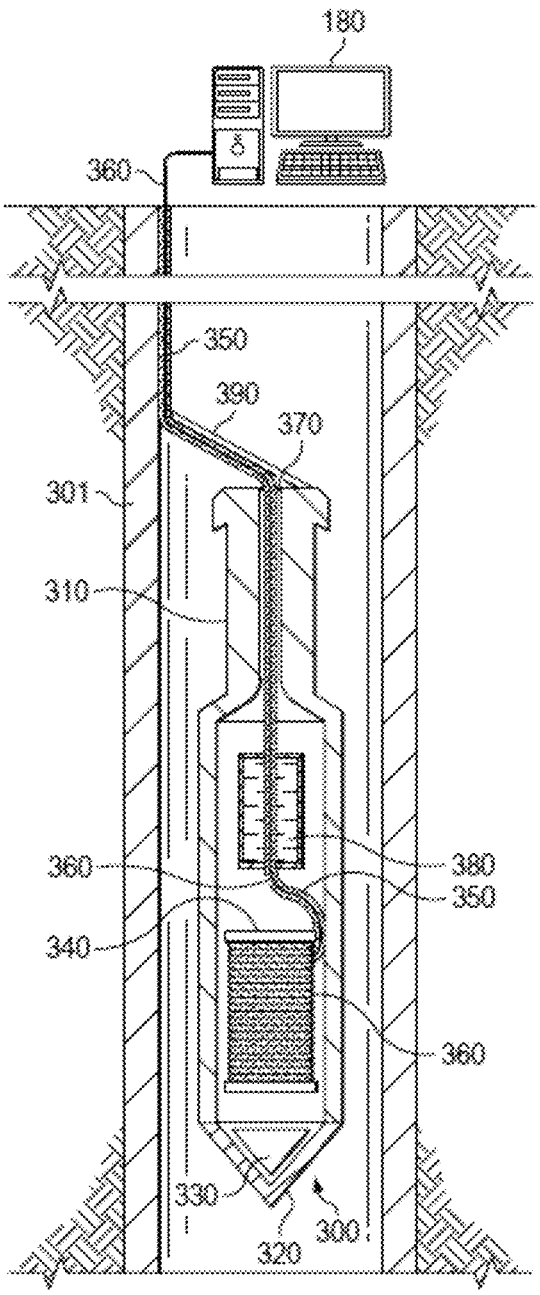

In FIG. 2A-B we see a schematic comparison of the two tools, with the prior art tool using the 200 series of numbers and the inventive tool using the 300 series. Describing the inventive tool 300 (see prior art tool 200) with housing 310 (210), nose cone 320 (220) housing sensor package 330 (230), although this may be positioned anywhere inside the housing. Also inside the housing 310 (210) is mounted bobbin 340 (240) with cable 360 (260) wound thereon and embedded in adhesive 350, rather than grease 250 as in the prior art. The cable unspools during deployment and exits cable port 370 (270). Tank 380 (not present in 2A) contains hardener, which is applied to the cable as it passes thereby. Pressor 390 (not present in 2A) presses cable 360 against casing 101, but this may be omitted, and buoyancy used in e.g., a horizontal section of well.

Figure 3:
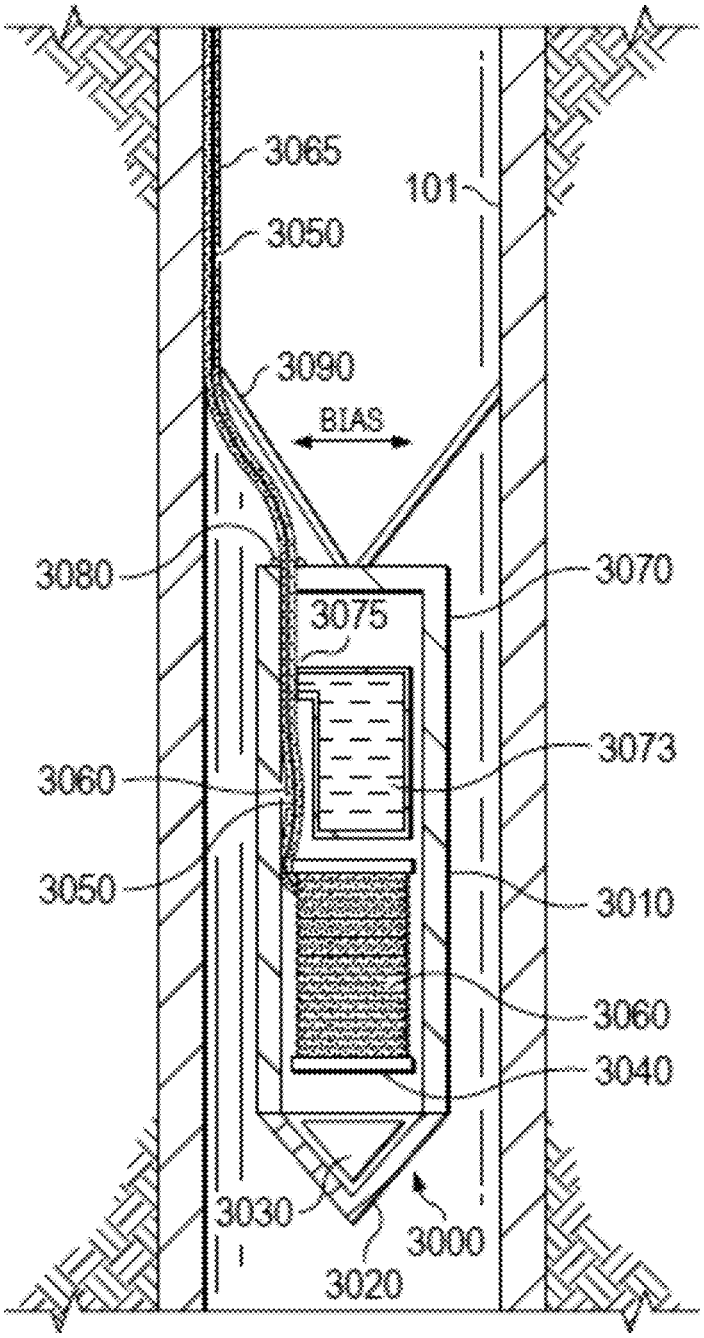
FIG. 3 One embodiment of a sensor cable installment tool.

In more detail, FIG. 3 shows tool 3000 inside well casing 101. Housing 3010 has a nose cone 3020 housing an electronic package 3030 including e.g., temperature sensor, pressure sensor, strain sensor, and/or wireless communication. Mounted inside the housing is bobbin 3040 with cable 3050 wound thereon and embedded in adhesive 3060. Hardener tank 3070 contains hardener 3073 which exits tank via outlet 3075 onto the cable as it passes thereby. The cable now has adhesive and hardener and exits the off center cable port 3080, and pressors 3090 are bias to push cable against the wall of casing 101. Thus, we see cable 3050 in a cured adhesive 3065 further uphole. Although we show hardener added before cable exit herein, we expect that it will be preferred that hardener reaches the cable at or behind the pressor function via feedline, as in FIG. 4.

Figure 4:
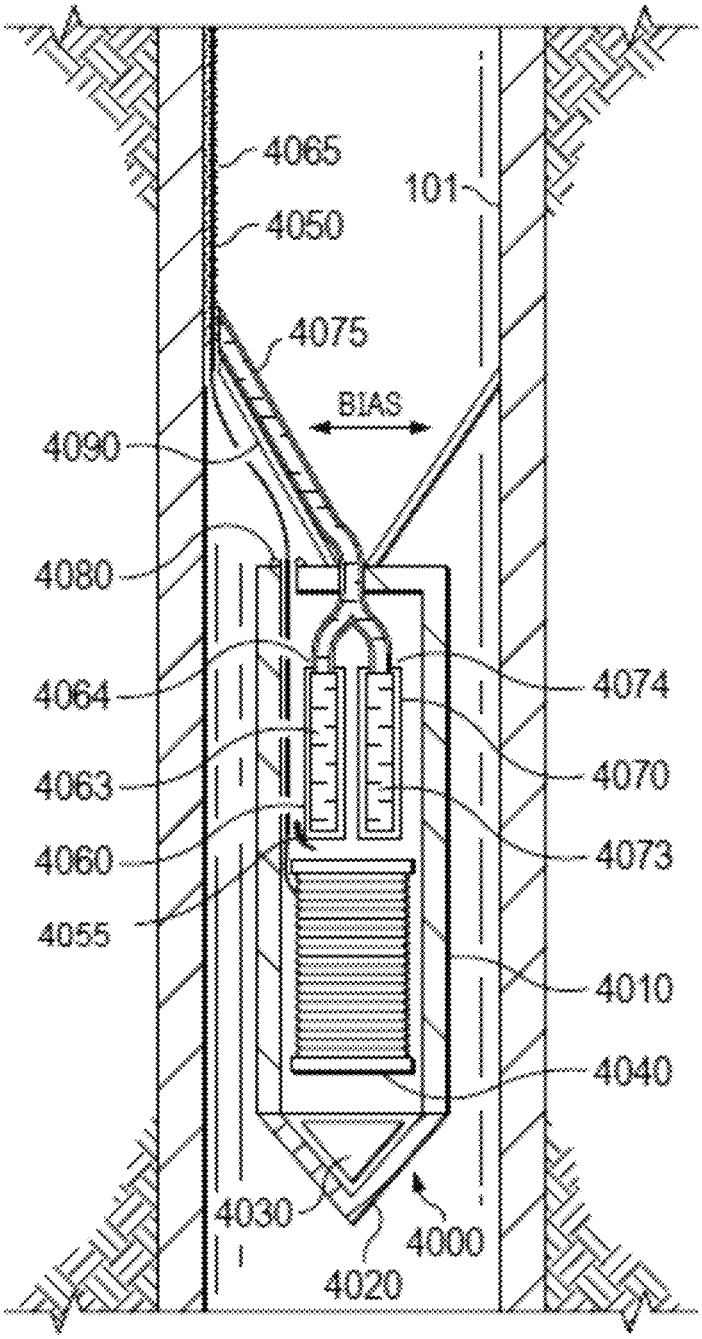
FIG. 4 Another embodiment of a sensor cable installment tool.

FIG. 4 shows an alternate embodiment of tool 4000 inside well casing 101, wherein both adhesive and hardeners are in separate tanks and mixed before adding to the cable after the cable passes the pressor, but similar parts have similar numbers to FIG. 3, using the 4000 series of numbers.

Thus housing 4010 has a nose cone 4020 housing an electronic package 4030 as in FIG. 3. Mounted inside the housing is bobbin 4040 with cable 4050 wound thereon, but the cable is dry. Cable guide 4055 ensure the cable is directed to the port 4080 and doesn't catch on interior components, such as a tank corner. Adhesive tank 4060 contains adhesive 4063 and hardener tank 4070 contains hardener 4073. These exit via outlets 4064 and 4074 to combine and move via feed line 4075 out of housing to be deposited on cable 4050 after it exits housing via port 4080 and passes pressor 4090 and thus is already pressed against casing 101. Thus, we see cable 4050 in a cured adhesive 4065 further uphole. In another alternative, the feed lines do not combine but deliver separate solutions to the cable. If desired, a spiral insert or baffles can be placed inside the joined feedline to assist in mixing the two liquids.

Figure 5:
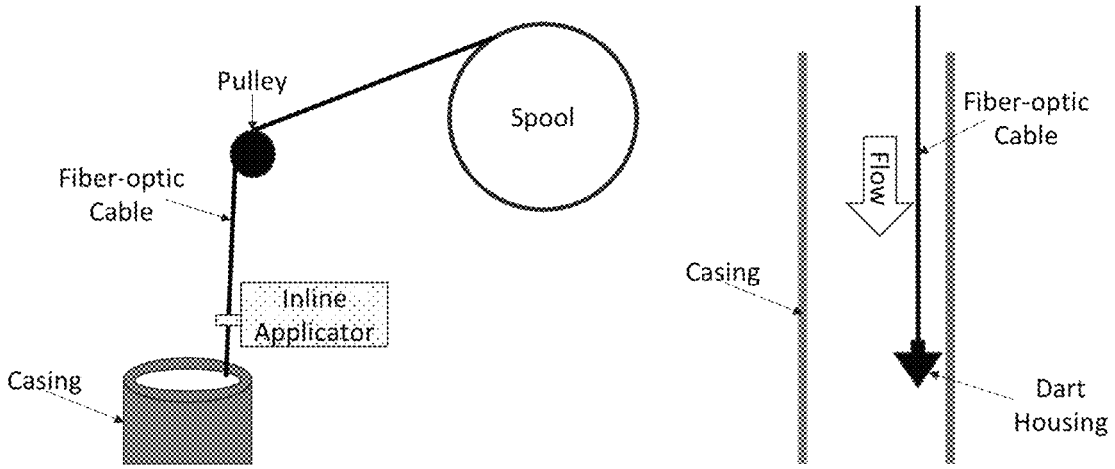
FIG. 5 a simple deployment method using an above well inline applicator to coat the cable to the glue and optional hardener as it is being deployed.

In another embodiment, the fiber-optic cable is installed with an surface mounted epoxy resin applicator (similar to a lubricator filled with epoxy resin) that coats the fiber-optic cable with resin and optionally a hardener as it is deployed down into the well casing, as shown in FIG. 5 wherein the pool and adhesive tank are at the surface, and adhesive added to cable as it is unwound and sent downhole. The cable may have a basket or dart or other weight object at the distal (downhole) end to pull the cable into the well bore via gravity. Fluid is pumped into the wellbore as the fiber-optic cable is extended, but does not dissolve or dilute the resin, and the resin allows the cable to be adhered to the wall of the casing. Once the fiber-optic cable reaches the end of the well bore, the dart may optionally be released or dissolve over time. Thus, the fiber-optic cable is run similar to a wireline. If needed, a pressor can be run downhole to press the cable against the tubing, but if the dart is small and deployed adjacent the tubing, it may not be needed, and other options are also possible.

Next an optional activator such as sodium hydroxide solution may be applied to the wellbore and the epoxy resin allowed to cure against the casing. Alternatively, the resin may already be premixed with a hardener and/or a delay agent. In yet other embodiments, the resin cures without added agents merely by time and temperature. In another embodiment, the epoxy is applied uniformly and with sufficient thickness to protect the fiber-optic cable once the epoxy hardens. If needed, a pressor can be sent down hole to press the cable against the wall, but in small diameter casing this may not be needed.

In one embodiment, the fiber-optic cable is installed after the casing is cemented but before production tubing is installed. Immediately after the casing cement is sufficiently set, an optional wash solution is run through the casing. The end of the cable affixed somewhere on the surface, and the fiber-optic spool already loaded with a settable adhesive and a resin hardener is sent down hole under gravity. The fiber-optic cable is thus run the entire length of the casing, being deployed with a mixture of adhesive resin and hardener resin coating the cable. If needed, the cable is pressed against the casing wall by the same tool or a separate tool. Once affixed the wellbore is shut-in and the epoxy is allowed to cure, dependent on the epoxy/hardener combination used. Once cured, the interrogator is installed and the DAS/DTS measurements are taken. The DAS/DTS measurements may be taken before, during, or after installation of the production tubing.

The following citations are each incorporated by reference in its entirety for all purposes.

U.S. Pat. No. 11,525,310 Method for installing fiber on production casing.

U.S. Pat. No. 10,955,264 Fiber-optic line for monitoring of well operations.

CRAWFORD, R., et al. "Disposable fibre optic surveys optimize wells and reduce $CO_2$ emissions in unconventional assets." Paper presented at the Asia Pacific Unconventional Resources Symposium. Brisbane, Australia, SPE-217339-MS.

The invention claimed is:

1. A method of installing a cable downhole in a well, comprising:

a) deploying a spool of cable down a casing in a well so that said cable unwinds and lies against an interior wall of said casing;

b) applying an epoxy resin and a hardener against said cable, wherein said epoxy resin is applied to said cable using an inline resin applicator at a surface during said deploying step a) and said hardener is applied after said cable is fully deployed; and c) hardening said epoxy resin so that said cable is affixed against said interior wall.

2. The method of claim 1, wherein said cable comprises at least a fiber-optic cable, a wireline, or a combination of one or more wirelines and fiber-optic cables.

3. A method of installing a cable downhole in a well, comprising:

a) deploying a spool of cable down a casing in a well so that said cable unwinds and lies against an interior wall of said casing;

b) applying an epoxy resin and optionally a hardener against said cable; and c) hardening said epoxy resin so that said cable is affixed against said interior wall;

wherein said deploying step uses a tool, said tool comprising:

i) a housing having a front end and a back end;

ii) said housing containing said spool that is configured to unwind said cable from said spool as said tool is deployed;

iii) said housing having a cable port for egress of said cable at said back end;

iv) two or more pressors attached to said housing and configured for outward bias of said pressors and said egressed cable against said interior wall;

v) said housing containing an adhesive tank containing said epoxy resin;

vi) said adhesive tank having an outlet fluidly connected to a first feed line;

vii) said first feed line depositing said epoxy resin onto said egressed cable at or behind said pressors.

4. The method of claim 3, wherein said cable comprises at least a fiber-optic cable, a wireline, or a combination of one or more wirelines and fiber-optic cables.

5. The method of claim 3, said housing further comprising a sensor package for measuring data selected from one or more of temperature data, pressure data, flow data, depth data, strain data and position data.

6. The method of claim 5, said housing comprising a communication package for wireless or optical or electrical communication of said data to a surface processor.

7. The method of claim 3, said hardener is selected from one or more of a UV light source, a temperature, oxygen, a chemical hardener or combinations thereof.

8. The method of claim 3, wherein said cable port is off-center so as to place said sensor cable directly against said casing.

9. The method of claim 3, wherein said housing remains in said well after said deploying step and dissolves over time.

10. A method of installing a cable downhole in a well, comprising:

a) deploying a spool of cable down a casing in a well so that said cable unwinds and lies against an interior wall of said casing;

b) applying an epoxy resin and a hardener against said cable; and c) hardening said epoxy resin so that said cable is affixed against said interior wall;

wherein said deploying step uses a tool, said tool comprising:

i) a housing having a front end and a back end;

ii) said housing containing said spool, said spool configured to unwind said cable from said spool as said tool is deployed;

iii) said housing having a cable port for egress of said cable at said back end;

iv) two or more pressors attached to said housing and configured for outward bias of said pressors and said egressed cable against said interior wall;

v) said housing containing an adhesive tank containing said epoxy resin and a hardener tank containing said hardener;

vi) said adhesive tank having an outlet fluidly connected to a first feed line and said hardener tank having an outlet fluidly connected to said first feed line or a second feed line;

vii) said first feed line depositing mixed epoxy resin and hardener onto said egressed sensor cable at or behind said pressors, or said first feed line and said second feed line depositing separate epoxy resin and hardener onto said egressed sensor cable at or behind said pressors.

11. The method of claim 10, wherein said cable comprises at least a fiber-optic cable, a wireline, or a combination of one or more wirelines and fiber-optic cables.

12. The method of claim 10, said housing further comprising a sensor package for measuring data selected from one or more of temperature data, pressure data, flow data, depth data, strain data and position data.

13. The method of claim 12, said housing comprising a communication package for wireless or optical or electrical communication of said data to a surface processor.

14. The method of claim 10, wherein said hardener is a chemical hardener.

15. The method of claim 10, wherein said cable port is off-center so as to place said cable directly against said casing.

16. The method of claim 10, wherein said housing remains in said well after said deploying step and dissolves over time.

* * * * *